United States Patent [19]

McKee

[11] 4,108,526

[45] Aug. 22, 1978

[54] COVER FOR MULTI-WIRE CONNECTOR

[75] Inventor: William H. McKee, West Covina, Calif.

[73] Assignee: TRW Inc., Elk Grove Village, Ill.

[21] Appl. No.: 796,556

[22] Filed: May 13, 1977

Related U.S. Application Data

[63] Continuation of Ser. No. 649,812, Jan. 16, 1976, abandoned.

[51] Int. Cl.[2] ..... H01R 13/58

[52] U.S. Cl. ..... 339/103 M; 339/206 R

[58] Field of Search ..... 339/103 M, 107, 206, 339/207, 208, 210

[56] References Cited

U.S. PATENT DOCUMENTS

| | | | |
|---|---|---|---|
| 3,518,616 | 6/1970 | Lewis | 339/107 |
| 3,550,066 | 12/1970 | Coates | 339/107 |
| 3,876,276 | 4/1975 | Ayer | 339/107 |
| 3,879,099 | 4/1975 | Shaffer | 339/107 |
| 3,904,265 | 9/1975 | Hollyday et al. | 339/103 M |
| 3,920,306 | 11/1975 | Barnett, Jr. et al. | 339/103 M |

*Primary Examiner*—Roy Lake
*Assistant Examiner*—DeWalden W. Jones
*Attorney, Agent, or Firm*—Neuman, Williams, Anderson & Olson

[57] ABSTRACT

A cover for a multi-wire connector having directly opposed wire-receiving channels in which wire-gripping jaws are disposed in the bottoms of the channels is adapted to be detachably positioned in snug engagement about the connector. The cover has inwardly projecting ribs adapted to interfit in the connector channels and overlie wire portions in electrical contact with contact jaws in the connector channels in the normal position of use, whereby the cover assists in preventing disengagement of the engaged wires from the connector. The cover comprises a one piece flexible strip having interlocking means disposed at terminal end portions whereby said cover may be readily engaged and disengaged from the connector.

14 Claims, 6 Drawing Figures

FIG. 3
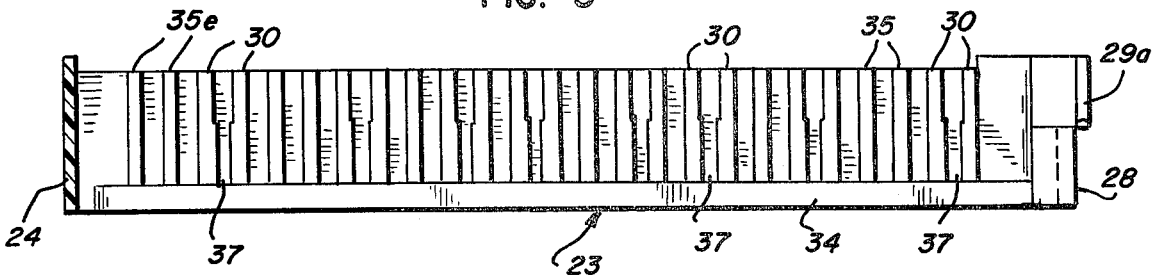
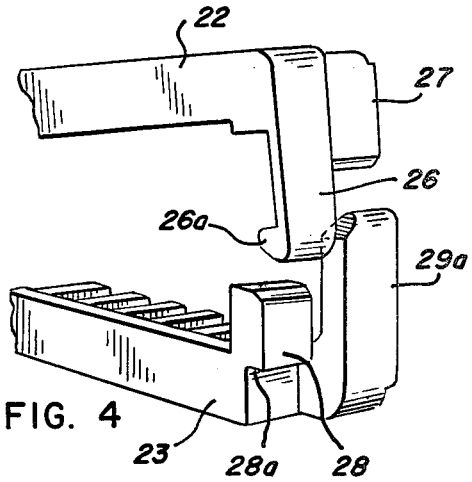
FIG. 4
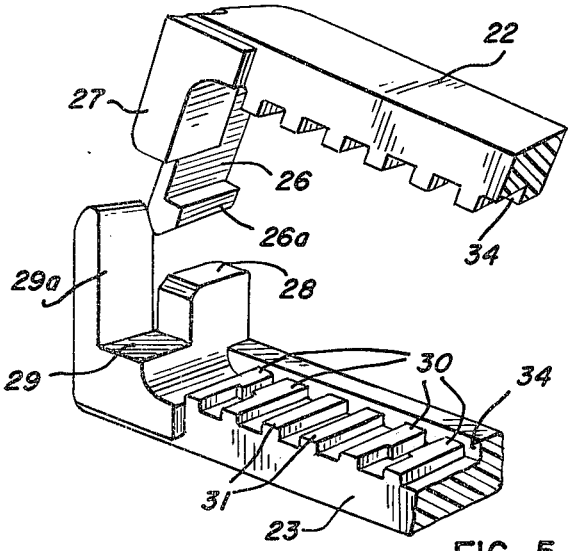
FIG. 5
FIG. 6
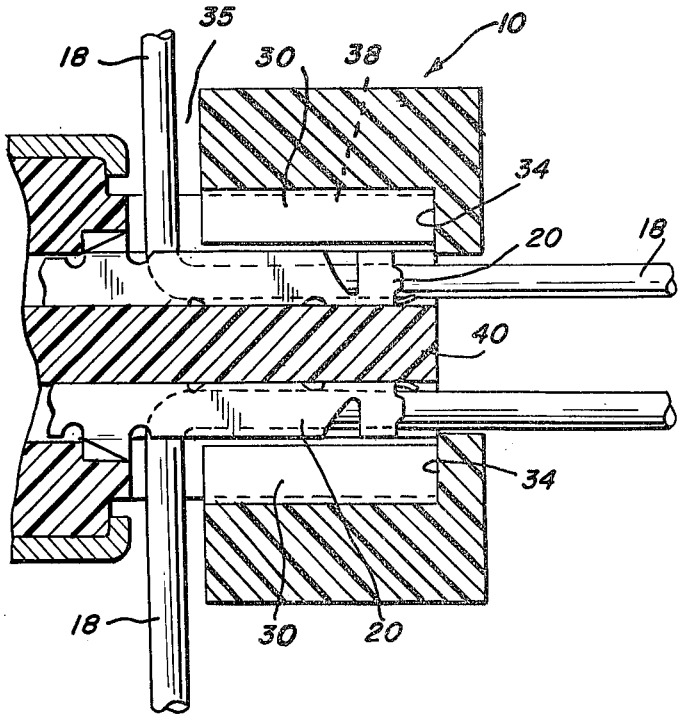

COVER FOR MULTI-WIRE CONNECTOR

This is a continuation of application Ser. No. 649,812 filed Jan. 16, 1976 now abandoned.

This invention relates to a novel cover construction for use with multi-wire solderless connectors, and more particularly, pertains to a one piece cover construction adapted to retain wires in a connector and prevent disengagement of connected wires from the wire-gripping elements disposed in the connector.

The provided cover construction also is adapted for use in the protective retention of wire conductors in connectors in which the conductors are in electrical contact with the connector intermediate the conductor ends, i.e., each conductor engaging such a connector does not end therein but extends from the connector at opposite sides of the contact after electrical connection is established. The latter type of connector/conductor engagements sometimes is referred to as a "half-tap."

The provided cover is particularly adapted for use with a multi-wire connector in which the conductors may approach such connector from a plurality of varied directions, whereby the use of a conventional protective hood for the connector is not feasible.

The provided cover is particularly adapted for use with connectors such as are disclosed in McKee U.S. application Ser. No. 443,678, filed Feb. 19, 1974 and which have opposed series of wire-receiving channels in which wire-gripping contact jaws are disposed in the channel bottoms. Miniature ribbon connectors of that type currently are being sold by TRW Inc. under the name CINCH RIBBON.

Although the prior art discloses the use of connector covers in patents such as Roberts et al. U.S. Pat. No. 3,824,530, granted July 16, 1974, such prior art covers are multi-part and not adapted for use with connectors of the type disclosed in the aforementioned MeKee application, and in addition do not provide the degree of conductor retention inherent in the cover construction provided by this invention.

It is an object of this invention, therefore, to provide a connector cover construction in which conductors disposed in connector wire-receiving channels are each retained in engagement with wire-engaging jaws disposed in each of said channels by an overlying cover rib also disposed in each of said channels and serving to prevent removal of the wire from the connector channel.

It is another object of this invention to provide a cover construction which is of one piece construction and is readily assembled into a position of use in conjunction with an encompassed connector by means of a simple interlocking of the distal ends of a unitary strip comprising the cover.

It is a further object of this invention to provide a connector construction which is of unitary construction and formed of resilient material and is readily placed in the operative and inoperative conditions by simple flexing operations.

It is another object of this invention to provide a one piece connector cover having a plurality of wire-retaining ribs some of which are formed to guide the connector into proper disposition within the cover periphery.

In one embodiment of the provided invention a multi-wire connector having a plurality of opposed wire-receiving channels with wire-gripping jaws disposed in each channel is encompassed by a cover. The cover comprises a unitary flexible strip having a general oblong rectangular peripheral configuration conforming with the periphery of the connector channel-containing portion and has interlocking means formed on opposed strip end portions. Spaced parallel side portions have inwardly projecting ribs adapted to interfit with the opposed channels of the connector, which channels extend from a centrally-located connector partition, after the cover strip is positioned thereabout and locked in place by means of the interlocking means.

The cover ribs project into the connector channels so as to overlie major portions of conductors disposed therein and assist in preventing removal of the conductors disposed in the channels in electrical communication with the wire-gripping jaws. The conductors typically are conductor wires covered by compressive insulation material. The cover ribs may terminate short of inward ends of the channel portions so as to provide gaps openings at those ends. Thereby, a half-tapped conductor may exist from the channel portions through the respective gap or opening, after entering from an outer open end of the channel and engaging the wire gripping jaws disposed therein. Certain ribs of the cover defining narrow slots effect a frictional lock by engaging barriers of the connector which define the wire-receiving channels.

DESCRIPTION OF THE DRAWINGS

FIG. 3 is a fragmentary elevational view partly broken away of a connector cover made in accordance with this invention illustrating the configuration of the ribs formed therein;

FIG. 4 is a fragmentary perspective view of the latching elements employed with the connector cover of the provided construction as viewed from the cover exterior;

FIG. 5 is a view of the latching elements of FIG. 4 illustrating the interior configuration of such elements; and FIG. 6 is a view taken on line 6—6 of FIG. 2.

Figure 1:
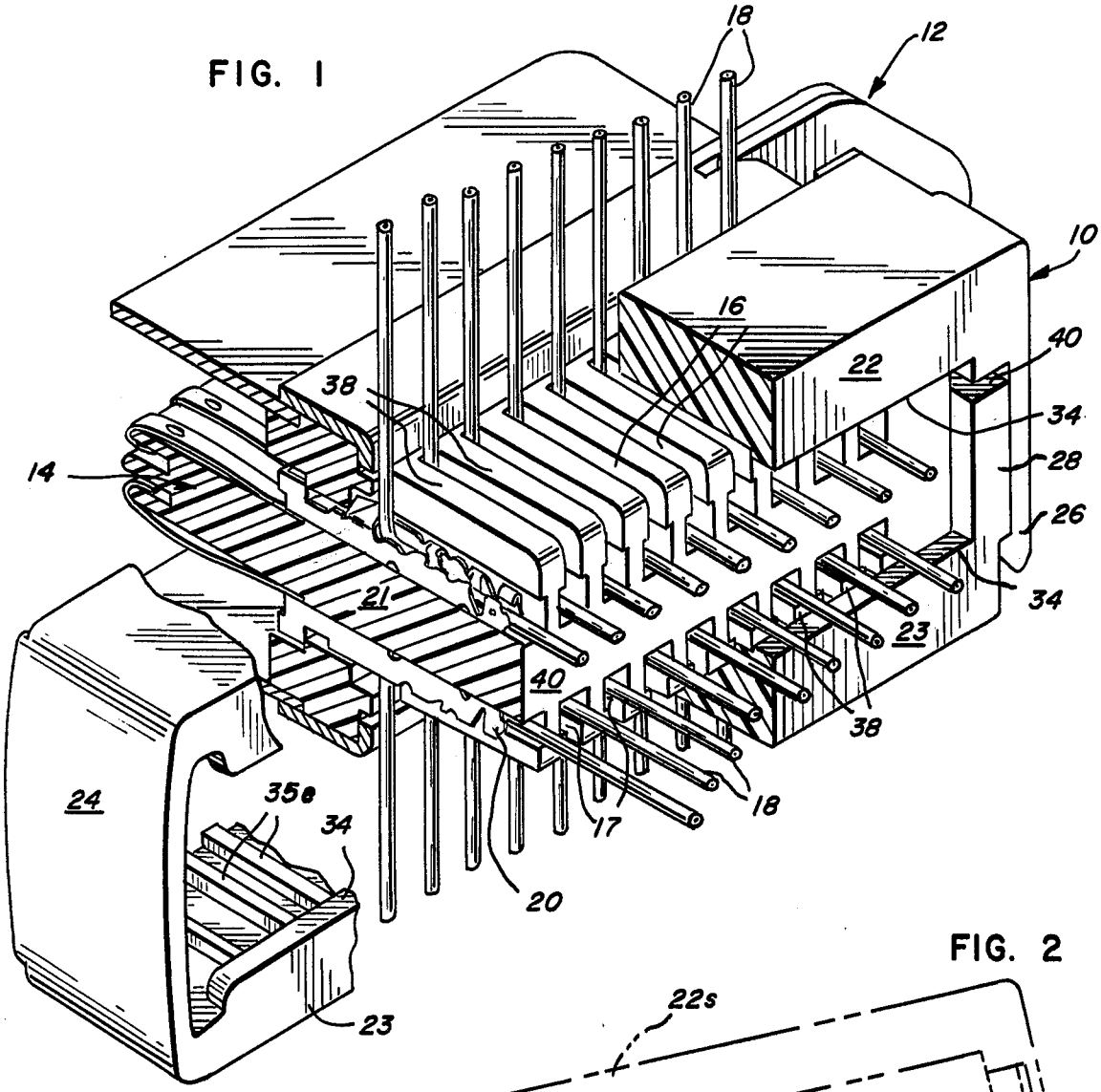
FIG. 1 is a fragmentary perspective view of one embodiment of a cover made in accordance with this invention, in a normal position of assembly with a multi-wire connector in which a plurality of conductors are "half-tapped"

Referring now more particularly to FIG. 1, a cover 10 made in accordance with this invention is fragmentarily illustrated in a position of use in surrounding relation with a multi-wire miniature ribbon connector 12 such as is manufactured by TRW Inc. of Elk Grove Village, Ill. Connector 12 by way of example may comprise a 50-contact polarized ribbon-type connector and be of a type of high density connector such as is employed in telephone systems. The connector comprises an insulator body portion 14 having integrally formed therein opposed rows of conductor-receiving channels 16 and 17 in which wires 18 are disposed in electrical communication with metal contact elements 20 illustrated in perspective in FIG. 1 and in side elevation in FIG. 6; an element 20 is located in the bottom of each channel 16 and 17. The channels extend from a central connector barrier 21.

It will be apparent from FIGS. 1 and 6 that the wires 18 engage the contacts 20 intermediate the wire ends which ends are disposed exteriorly of the connector 12 for engagement with other terminal points. It is thus seen from FIG. 1 that wires 18 engaging contacts 20 in electrical communication enter the connector channels 16 through their outer ends at the top of the connector (from the right in FIG. 1). The wires at each side of the central barrier 21 then exit at the inward ends of the channels at approximately right angles to the longitudinal axes of the contacts 20, after being bent approximately 90° to extend outwardly in opposite directions (upward and downward as seen in FIG. 1).

Since the wires 18 do not end in the connector 12, axial forces exerted along the wires 18 in a direction laterally away from the connector have a tendency to remove the wires from engagement with contacts 20 and break the electrical connection. It is the function of the provided cover 10 to protect the wires against inadvertent removal forces being applied and to retain the wires in connector 12 and eliminate or minimize the breaking of electrical connections between the conductors and the connector should forces be exerted on the wires tending to remove the same from the connector.

Figure 2:
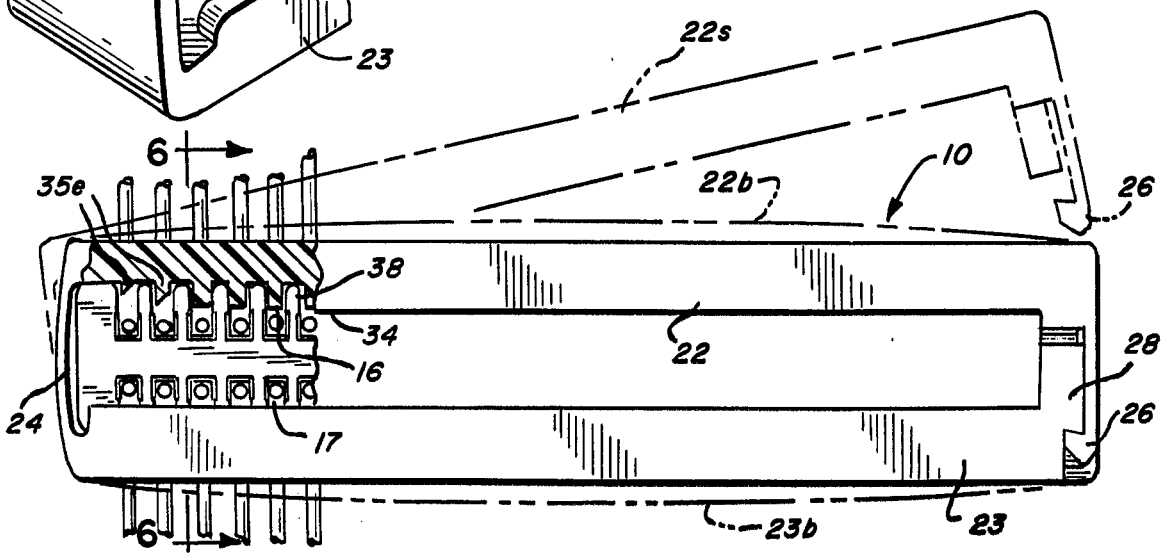
FIG. 2 is a fragmentary end view partly broken away of a cover made in accordance with this invention in engagement with a multi-wire connector.

As seen from FIG. 2 cover 10 is of one piece construction having opposed elongate side portions 22 and 23 integrally formed with a flexible hinge 24. The cover is formed of a flexible thermoplastic material such as a polyester and the sides 22 and 23 are adapted to flex relative to hinge 24 without cracking or fracture.

Cover side 22 is integrally formed at its distal end opposite hinge 24 with latching hook portion 26 (see FIGS. 4 and 5), and side 23 is integrally formed with mating latch block portion 28, which portions effect a latching action retaining the opposed sides interlocked when interengaged in the manner illustrated in FIG. 2 in full lines. In the latching condition a block latch portion 27 of cover side 22 extends adjacent a stop surface 29 of side 23 and also extends adjacent a support and alignment finger 29*a* as projecting latch finger 26*a* slidably moves over the outer surface of block portion 28 and snaps beneath shoulder 28*a* by the inherent resilience of finger 26. The outer end of block 28 also opposes side 22 adjacent the base of finger 26. The adjacent sides of fingers 26 and 29*a* and of blocks 27 and 28 provide lateral support to preclude relative lateral movement between the latched ends of the cover. This construction defines a compact construction of interfitted parts.

Projecting from opposed inner surfaces of cover sides 22 and 23 are ribs 30 and 31 adapted to be interfittingly received in the connector channels 16 and 17 in the manner illustrated in FIGS. 1 and 2. The height of the cover sides (the width left-to-right as seen in FIG. 6) is somewhat less than the length of the barrier channels 16 and 17 in which the contacts 20 are positioned. A short projecting ledge 34 extends inwardly toward the connector central longitudinal axis along the bottom edge of each cover side 22 and 23, see FIG. 5. Each ledge 34 serves as a stop surface against which the outer distal terminal ends of insulating barriers 38 (FIGS. 1 and 6) defining the connector channels 16 and 17 abut, thereby fixing the extent of a gap 35 (FIG. 6) between the cover sides and the inward ends of the channels through which half-tapped wires 18 may pass to or from the contacts 20 of a connector 12. The gap 35 defines the interval between the innermost ends of the cover ribs and the connector body portion from which barriers 18 extend.

It will be noted from FIG. 2 that the cover ribs 35*e* of side 22 disposed adjacent hinge 24 are of reduced height and are beveled at their inward ends to facilitate initial application of the open cover over the connector. The cover is placed on a connector while the sides 22 and 23 are in a normal relaxed spread position relative to the hinge 24 to assume an angular disposition such as depicted by the phantom line side 22*s* in FIG. 2. The connector and cover are assembled by relative endwise movement of the connector against the hinge 24 as in FIG. 2. Since end ribs 35*e* are of reduced height, the cover sides need be spread apart only to the angle represented by side 22*s* relative to side 23 to allow passage and full insertion of the cover over the connector and against the hinge. It will be noted from FIG. 2 that the beveled rib ends of reduced height serve to guide the connector in the direction of the hinge.

The rib arrangement on side 23 is the mirror image of the opposed side 22 and is shown in elevation in FIG. 3.

As illustrated in FIG. 2 the third and fourth ribs from the hinge 24 frictionally engage an interposed barrier 18, the third and fourth ribs being wider or thickened ribs 30 as seen in FIG. 3. The opposed wider ribs 30 define narrow slots 37 for frictionally engaging connector barriers 38 in the manner depicted in FIG. 2 and may resiliently deform in the course of frictionally receiving such barriers.

After assembly of a cover 10 straddle of a connector end, with the ribs 30 and 31 properly aligned with the channels 16 and 17, the cover is closed by a simple squeezing together of latch ends 26 and 28 until these parts snap together in latching engagement with one another.

It also will be noted from FIG. 2 that when the cover sides 22 and 23 are first interlocked by latching portions 26 and 28, the sides 22 and 23 remain bowed outwardly in the form of phantom line side fingers 22*b* and 23*b* as illustrated. In this position, the cover ribs 31 and 30 project toward the connector channels 16 and 17 but are not interlocked therewith. With the cover sides in the phantom line positions 22*b* and 23*b* of FIG. 2 the middle portions of the opposed sides also are squeezed inwardly so that narrow slot portions 37 defined by the thicker cover ribs 30 (see FIGS. 3 and 5), lockingly engage the respective interfitting barriers 38. Thus the cover sides are urged into locking parallel relation with the connector sides and assume the full line positions of FIG. 2.

Accordingly, in the normal course of cover assembly, the cover with the sides 22, 23 spread apart first receive the end of the connector 12 which is positioned against cover hinge 24. The sides then are latched into the bowed condition of FIG. 2, whereafter inward pinching pressure applied to the midles of the opposed sides effects a frictional locking engagement between the respective barriers 18 which mate with the narrow spaces between the opposed pairs of thicker ribs 30.

As seen in FIG. 6 a cover rib 30 or 31 lies in each connector channel 16, 17 tending to retain the wire 18 therein in electrical engagement with metal contact 20. Pulling forces exerted on the wires tending to remove the same from the connector will be resisted by the cover which serves as a strain relief device.

In addition to functioning with connectors in which the wires are contacted intermediate their ends to form "half-taps" the provided cover construction is used to advantage in any installation in which protection must be afforded the wires in electrical communication with the contacts of a multi-wire connector of the type disclosed. Thus wires which are simultaneously cut and driven into electrical engagement with the connector contact may also be protected by the provided cover if employed in an environment where a protective connector hood cannot be employed, as where the wires are to extend in a plurality of directions directly from the connector contact channel ends (to the right in FIG. 1).

The provided cover may be readily molded from a variety of thermoplastic materials and should be sufficiently resilient to flex the desired distances to allow engagement with a connector in the manner above described without cracking or fracturing. By way of one specific example, the ribs 30 and 31 may be about 0.278 inch long, about 0.044 inch in height, and about 0.038 inch wide for mating with connectors having spaces about 0.043 inch wide between barriers 38. The ribs 30 are thicker by about 0.007 inch over approximately 0.125 inch length to provide a 0.033 inch space therebetween for force fit reception of barriers 38 and about 0.042 inch thickness. When properly applied to a connector each of these ribs 30 and 31 may extend to within about 0.010 inch of a fully seated wire 18 to preclude disengagement of the wires from electrical contact with the respective contact 20.

The flexibility inherent in the plastic cover allows unlatching of the same if necessary. It will be noted from FIG. 1 that wne latched together hook 26 may move beyond latch portion 28 as indicated by the gap 40 therebetween.

The provided cover is readily assembled to a connector construction, being a unitary self locking piece. The simplicity of design renders the same susceptible to being manufactured by simple molding operations.

It will be appreciated that the aforementioned objects of this invention have been met.

In view of the various embodiments of the above described invention which may be made, particularly in the light of the above teachings, this invention is to be limited only by the scope of the appended claims.

What is claimed is:

1. A cover construction for use with a multi-wire connector having a plurality of parallel open-sided and open-ended wire-receiving channels defined by connector barriers and having wire engaging means disposed in such channels; said cover construction being formed of a discrete one-piece strip of flexible material adapted to snugly encompass the connector over such channels and having projecting ribs for reception in such connector channels and for interfitting with at least some of the connector barriers in a frictional interlock; each of said ribs being of a length so as to extend over a substantial portion of the length of the channel in which disposed and of a height so as to overlie in adjacent relationship a wire disposed in such channel whereby said ribs retain wires disposed in such wire-receiving channels in engagement with such wire engaging means; opposed end portions of said strip having disengageable interlocking means thereon for maintaining said strip in snug encompassing relation with the connector when in the engaged condition, and for allowing release of the strip from encompassing relation with the connector when in disengaged condition.

2. The cover construction of claim 1 in which said cover has opposed parallel side portions joined at one pair of adjacent ends by a flexible hinge integrally formed with said one pair of ends, and connectable at an opposed pair of adjacent ends by said disengageable interlocking means.

3. The cover construction of claim 1 wherein said ribs are of a length less than the length of said wire-receiving channels to permit application of said cover over wires which pass through said channels.

4. In combination, a multi-wire connector having opposed series of wire-receiving channels defined by connector barriers extending from a central connector partition; each of said channels having wire-gripping jaws disposed therein; a disengageable cover overlying said opposed series of channels and having projecting ribs extending from one surface thereof into said connector channels in adjacent relationship with said wire-gripping jaws; said cover comprising a flexible strip having opposed facing side portions from which said ribs project; said sides being joined and integrally formed at first end limits by a flexible hinge portion enabling the opposed sides to move relative to each other; said ribs projecting from said sides being received in said connector channels and retaining wires disposed in said wire-gripping jaws in engagement with said jaws; said cover sides being formed at second end limits with disengageable interlocking means adapted to maintain said cover in snug encompassing engagement with said connector channels when said interlocking means are in the engaged position and adapted to allow said cover to disengage from said connector when in the disengaged position; at least some of said cover ribs having narrow intervals therebetween; said connector barriers being snugly received in said cover rib narrow intervals so as to effect a frictional interlock therewith.

5. The combination of claim 4 in which said opposed connector channels have open ends oppositely disposed to said connector partition and open sides in which wires to be engaged by said jaws are received; said cover ribs extending into said connector channels from the channel open sides and being spaced from the connector central partition whereby wires engaging said jaws in said connector may traverse said channels from the open ends thereof, be engaged by the jaws disposed in the channels, and extend from said channels in the intervals between said cover ribs and said connector partition.

6. The combination of claim 4 in which said strip sides have a ledge portion extending transversely to the side ribs and disposed at one end limit of said ribs; said ledge being adapted to engage the end limits of said connector barriers when said cover is in overlying engagement with said connector whereby said cover is positioned relative to said connector ribs.

7. The combination of claim 4 in which said cover sides are of such size as to be bowed out at the sides when disposed about said connector and latched; said sides in the bowed condition being inwardly moveable so as to urge said cover ribs defining said narrow intervals into interlocking engagement with the respective aligned connector barriers and thereby fix said cover sides in substantially planar configuration.

8. A cover construction for use with a multi-wire connector having a plurality of parallel open-sided and open-ended wire-receiving channels and having wire engaging means disposed in such channels; said cover construction being formed of a discrete one-piece strip of flexible material adapted to snugly encompass the connector over such channels and having projecting ribs adapted to interfit with the individual connector channels and overlie portions of wires disposed in such channels, for retaining wires disposed in such wire-receiving channels in engagement with such wire engaging means; opposed end portions of said strip having disengageable interlocking means thereon for maintaining said strip in snug encompassing relation with the connector when in the engaged condition, and for allowing release of the strip from encompassing relation with the connector when in disengaged condition; said cover having opposed parallel side portions joined at one pair of adjacent ends by a flexible hinge integrally formed with said one pair of ends, and connectable at an opposed pair of adjacent ends by said disengageable interlocking means, and said strip projecting ribs projecting from opposed facing surfaces of said parallel side portions; the opposed ribs of said strip sides disposed closest to said strip hinge being of lesser height than the remainder of said ribs.

9. The cover construction of claim 8 in which said closest ribs have beveled end surfaces converging in the direction of the connector hinge.

10. In combination, a multi-wire connector having opposed series of wire-receiving channels defined by connector barriers extending from a central connector partition; each of said channels having wire-gripping jaws disposed therein; a disengageable cover overlying said opposed series of channels and having projecting ribs extending from one surface thereof into said connector channels in adjacent relationship with said wire-gripping jaws; said cover comprising a flexible strip having opposed facing side portions from which said ribs project; said sides being joined and integrally formed at first end limits by a flexible hinge portion enabling the opposed sides to move relative to each other; said ribs projecting from said sides being received in said connector channels and retaining wires disposed in said wire-gripping jaws in engagement with said jaws; said cover sides being formed at second end limits with disengageable interlocking means adapted to maintain said cover in snug encompassing engagement with said connector channels when said interlocking means are in the engaged position and adapted to allow said cover to disengage from said connector when in the disengaged position; said opposed connector channels having open ends oppositely disposed to said connector partition and open sides in which wires to be engaged by said jaws are received; said cover ribs extending into said connector channels from the channel open sides and being spaced from the connector central partition whereby wires engaging said jaws in said connector may traverse said channels from the open ends thereof, be engaged by the jaws disposed in the channels, and extend from said channels in the intervals between said cover ribs and said connector partition; at least some of said cover ribs having narrow intervals therebetween; said connector barriers being snugly received in said cover rib narrow intervals so as to effect a frictional interlock therewith.

11. In combination, a multi-wire connector having opposed series of wire-receiving channels defined by connector barriers extending from a central connector partition; each of said channels having wire-gripping jaws disposed therein; a disengageable cover overlying said opposed series of channels and having projecting ribs extending from one surface thereof into said connector channels in adjacent relationship with said wire-gripping jaws; said cover comprising a flexible strip having opposed facing side portions from which said ribs project; said sides being joined and integrally formed at first end limits by a flexible hinge portion enabling the opposed sides to move relative to each other; said ribs projecting from said sides being received in said connector channels and retaining wires disposed in said wire-gripping jaws in engagement with said jaws; at least some of said ribs having narrow intervals therebetween; said cover sides being formed at second end limits with disengageable interlocking means adapted to maintain said cover in snug encompassing engagement with said connector channels when said interlocking means are in the engaged position and adapted to allow said cover to disengage from said connector when in the disengaged position; said cover sides being of such size as to be bowed out at the sides when disposed about said connector and latched; said sides in the bowed condition being inwardly movable so as to urge said cover ribs defining said narrow intervals into interlocking engagement with the respective aligned connector barriers and thereby fix said cover sides in substantially planar configuration, said cover being formed of a resilient polyester material; the last-mentioned ribs being deformed in the course of effecting an interlocking engagement with the connector barriers.

12. In a cover construction for use with a multi-wire connector having a plurality of parallel open-sided and open-ended wire-receiving channels defined by connector barriers and having wire engaging means disposed in such channels; said cover construction being adapted to snugly engage the connector over such channels, and having projecting ribs for reception in such connector channels; each of said ribs overlying a wire disposed in each of such channels whereby said ribs retain wires disposed in such wire-receiving channels in engagement with such wire engaging means; the improvement in such cover construction comprising projecting ribs on said strip of such configuration for reception in such connector channels and for interfitting with at least some of the connector barriers in a frictional interlock.

13. The cover construction of claim 12 in which said cover comprises a single strip of flexible material for encompassing the entire periphery of such connector in snug engagement; said single strip having disengageable interlocking means thereon for maintaining said strip in engagement with the connector and for allowing release of the strip from encompassing relation with the connector when is disengaged condition.

14. The cover construction of claim 12 in which each of said ribs is of such length as to extend over a substantial portion of the length of the channel in which disposed and of such a height as to overlie in adjacent relationship a wire disposed in such channel.

* * * * *

UNITED STATES PATENT AND TRADEMARK OFFICE

CERTIFICATE OF CORRECTION

PATENT NO. : 4,108,526
DATED : August 22, 1978
INVENTOR(S) : William H. McKee

It is certified that error appears in the above-identified patent and that said Letters Patent are hereby corrected as shown below:

Column 2, line 18, after "gaps" insert -- or --.

Claim 13, column 8, line 54, change "is" to -- in --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*